US005139292A

United States Patent [19]

Beals

[11] Patent Number: 5,139,292

[45] Date of Patent: Aug. 18, 1992

[54] EMERGENCY EXIT ALARM LOCK

[75] Inventor: L. Ralph Beals, Russellville, Ark.

[73] Assignee: Ralph's Welding Inc., Russellville, Ark.

[21] Appl. No.: 723,792

[22] Filed: Jul. 1, 1991

[51] Int. Cl.[5] ..... E05C 9/04

[52] U.S. Cl. ..... 292/92; 292/36; 292/21

[58] Field of Search ..... 292/7, 21, 92, 93, 339, 292/259, 36

[56] References Cited

U.S. PATENT DOCUMENTS

| | | | |
|---|---|---|---|
| 2,674,480 | 4/1954 | Vigmostad | 292/7 |
| 3,314,703 | 4/1967 | Fitzpatrick | 292/21 |
| 3,724,130 | 4/1973 | Bogue | 292/259 X |
| 4,271,691 | 6/1981 | Logan | 70/DIG. 49 X |
| 4,387,917 | 6/1983 | Cocker | 292/93 X |
| 5,010,747 | 4/1991 | Norden, Jr. | 292/259 R X |

*Primary Examiner*—Richard E. Moore
*Attorney, Agent, or Firm*—Stephen D. Carver

[57] ABSTRACT

An alarm lock for securely locking both edges of an emergency exit door. A rigid, hollow housing mounts upon an existing door between opposing door facings. A pair of rigid, elongated rods is longitudinally displaceable within the housing between a locked position and an unlocked position. The rods are driven by a coupler confined within the housing and coupled to a rotatable crank controlled by a paddle arm handle assembly. The crank is journaled for rotation about a rigid axle which projects through the housing interior. Movement of the handle rotates the crank, selectively extending and retracting the rods into and out of engagement with the door casings. A panel mounted on the paddle arm clearly displays instructions for emergency use. When the handle is activated, a rigid follower associated with one of the rods forcibly contacts an alarm switch to activate an audible transducer. The alarm may be manually disarmed and reset by manipulation of a key switch. The handle assembly and alarm assembly are secured within rigid casings to prevent tampering or destruction.

7 Claims, 4 Drawing Sheets

EMERGENCY EXIT ALARM LOCK

BACKGROUND OF THE INVENTION

The present invention relates generally to security door locks. More particularly, my invention relates to security locks comprising quick-release latches for emergency egress. The lock preferably employs an audible alarm or other means for signaling an emergency exit or unauthorized opening.

As is well known, incidences of forcible breaking and entering in public and commercial buildings have increased dramatically over the years. Accordingly, the demand for reliable security systems has increased sharply. Public awareness of rising crime rates, increased attention to crime prevention efforts, and insurance considerations give impetus to the development of dependable security systems.

Conventional rim locks are generally unsatisfactory for many applications. They provide only a narrow, usually spring-biased bolt that penetrates a shallow port mounted to the door casing. With minimum force and simple tools, the bolt can be easily pried out of engagement with the catch.

Security "deadbolt" locks, on the other hand, penetrate the door casing and project deeply into a port defined through the door frame. Even with the use of a pry bar, the end of the elongated bolt cannot be easily reached and disengaged from its port. Therefore, the effectiveness of deadbolt locks is acknowledged throughout the industry.

However, the conventional deadbolt lock also has its disadvantages. For example, a deadbolt lock comprises a key access port. A well-equipped intruder may quickly manipulate the key port and gain forcible entry by destroying the locking components in the cylinder. Moreover, the conventional deadbolt lock secures only the unhinged portion of the door. The lock thus does not prevent the would-be intruder from removing the door hinges to gain unauthorized entry.

Paddle arm locks usually found on emergency exits typically comprise a rigid, hollow casing adapted to mount to the interior of the door near the hand grip. A rotatable paddle arm handle mechanically releases an elongated, generally spring-biased latch bolt. These locks commonly comprise some form of built-in alarm system adapted to alert an emergency condition in the building.

However, prior art paddle arm locks known to me do not achieve satisfactory deadbolt action. While they do offer an additional barrier, such locks are also fairly easy to disengage. In addition, the alarm switching system of such locks is easily disabled or inadvertently tripped. Because they are operated infrequently, they become easily jammed or difficult to open.

Hence, it is desired to provide a security locking system that positively locks a door against undesired intrusions and which overcomes the disadvantages associated with typical deadbolt and paddle arm systems.

SUMMARY OF THE INVENTION

My new alarm lock is particularly well-adapted for use on relatively heavy, metallic emergency exit doors of the type found in commercial buildings such as warehouses or the like. The lock comprises an elongated housing that may be conveniently mounted on the doors without extensive modifications. The housing preferably extends the full width or length of the door, so that its locking rods penetrate opposing door facings. A pivotal paddle arm comprising a legible instruction panel projects outwardly from the front of the housing. In case of an emergency, the arm may be easily pushed to open the door, simultaneously activating an alarm to warn others in the building of the emergency.

The paddle arm is mechanically coupled to the interior locking rods which project through the hollow interior of the housing. The locking rods are axially displaced out of the housing ends to engage the door facings. The locking rods are controlled by a mechanical linkage comprising a rigid link that extends between a portion of the paddle arm and a rotatable crank. The crank is rotatably connected to a rigid, rotatable coupler which is pivotally pinned to the locking rods at both of its ends. When the paddle arm is moved, it deflects the link, which rotates the crank and thus the coupler to deflect the rods. Because the rods and the coupler are confined within the walls of the housing, the rods cannot escape from the coupler. As the coupler moves, the rods are simultaneously extended into or retracted out of engagement with the door casings.

A rigid follower projects integrally upwardly from one of the locking rods and establishes contact with an alarm switch. When the handle is turned and the rod moves, the follower forcibly contacts a switch that activates the alarm.

Preferably the alarm comprises a pair of battery-powered audio transducers. Alternatively, the alarm switch may be coupled to an existing A.C. line and wired to an electric alarm system located in a remote security station. Preferably, the alarm may only be disarmed by deployment of a key switch. The alarm switch may then be manually reset for subsequent activation.

Both the handle assembly and alarm assembly are preferably securely housed within rigid shrouds to prevent undesired tampering or destruction.

Thus a fundamental object of the present invention is to provide a security emergency lock for doors that is highly reliable and absolutely safe.

A further broad object of the present invention is to provide an alarm lock for emergency exit doors.

A similar broad object of the present invention is to provide a deadbolt lock that can be readily opened in the event of an emergency.

It is a further broad object of the present invention to provide a security lock system that automatically activates an alarm when opened.

Yet another object of the present invention is to provide an emergency exit lock of the nature described which penetrates the door casing on both sides or ends of the door.

An additional object of the present invention is to provide an emergency exit lock that can be adapted for use on dual-door exits.

Still another object of the present invention is to provide an emergency exit door lock that incorporates an audible alarm system.

A further object of the present invention is to provide a manually deployable emergency exit door lock that can be coupled to a remote alarm system to alert of unauthorized use.

An additional object of the present invention is to provide an emergency door lock that absolutely controls the locking rods, and which cannot fail.

Another object is to provide a lock that avoids springs, nuts, bolts or other unreliable fasteners.

A related object is to provide a lock of the character described which is substantially fireproof.

Still another object of the present invention is to provide an improved emergency exit alarm lock of the character described which provides protective housings to prevent unauthorized tampering or destruction of the mechanical components.

Yet another object of the present invention to provide a door lock of the nature described which can be readily mounted on existing doors without special tools and knowledge.

Yet another object of the present invention is to provide an emergency exit lock of the character described which operates independent of an external power system and requires minimum routine maintenance.

These and other objects and advantages of my invention will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
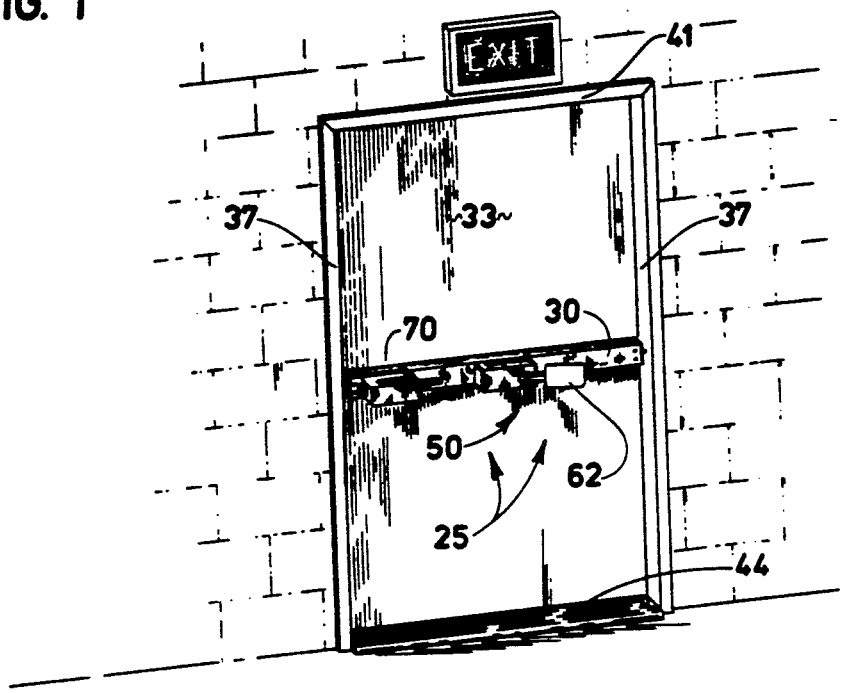
FIG. 1 is a fragmentary pictorial view illustrating the best mode of my new Emergency Exit Alarm Lock installed on a metallic door.

With reference to FIG. 1 of the accompanying drawings, my new emergency exit alarm lock is broadly designated by the reference numeral 25. Lock 25 comprises an elongated housing 30 that may be bolted to an existing door 33. Preferably housing 30 extends across door 33 between opposing door facings 37. Alternatively, lock 25 may be mounted lengthwise so that it extends between the door crown 41 and threshold 44.

Lock 25 is locked and unlocked by manipulation of a handle assembly broadly designated by the reference numeral 50. When the lock is released to open the door, handle 50 preferably activates an alarm system broadly designated by the reference numeral 70 to alert of an emergency.

Figure 2:
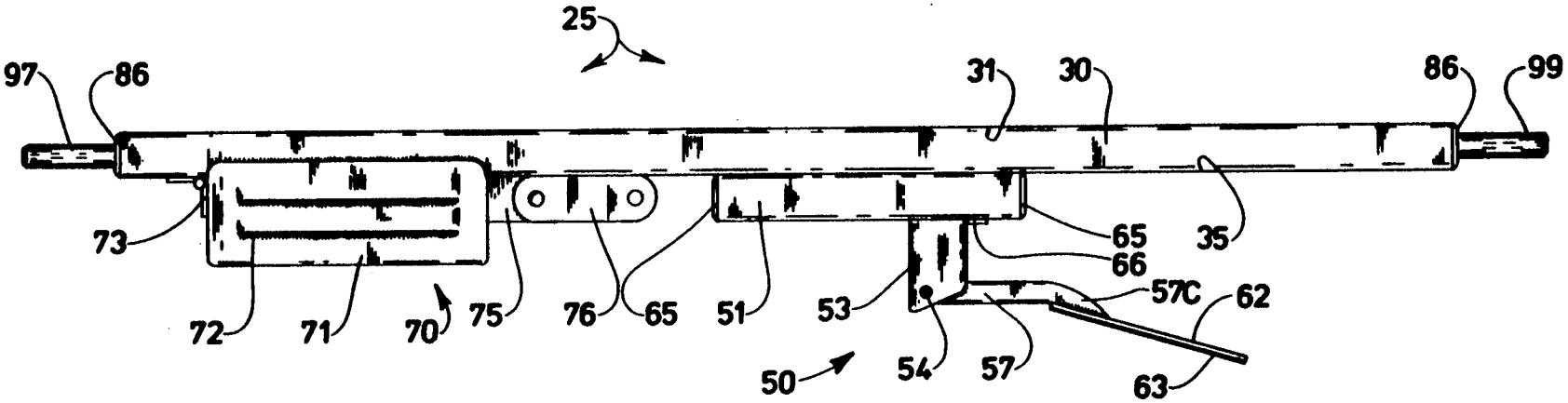
FIG. 2 is a partially fragmentary top plan view thereof, showing the rods in an extended position.
Figure 3:
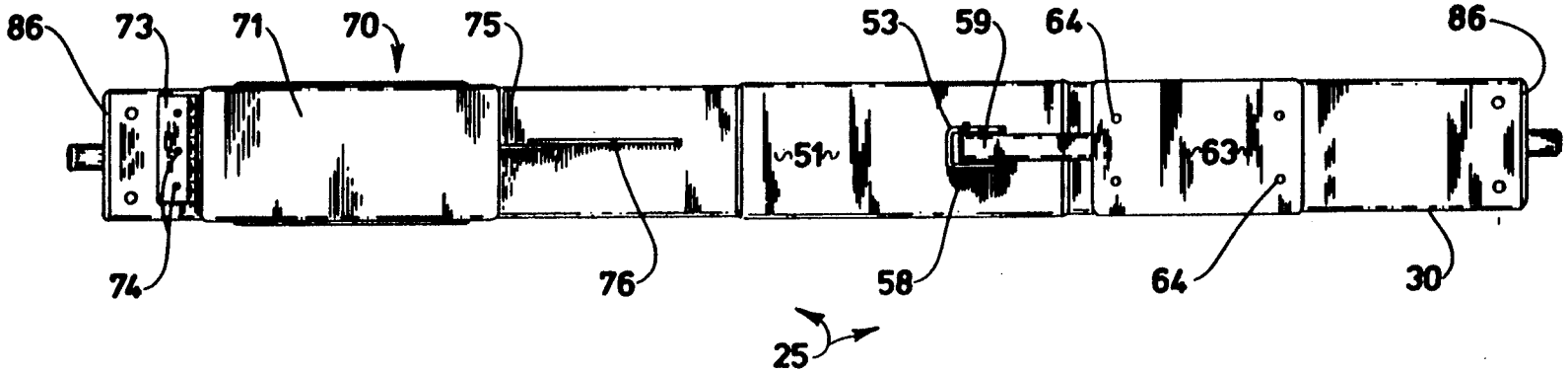
FIG. 3 is a front elevational view thereof, showing the rods in a retracted position.
Figure 4:
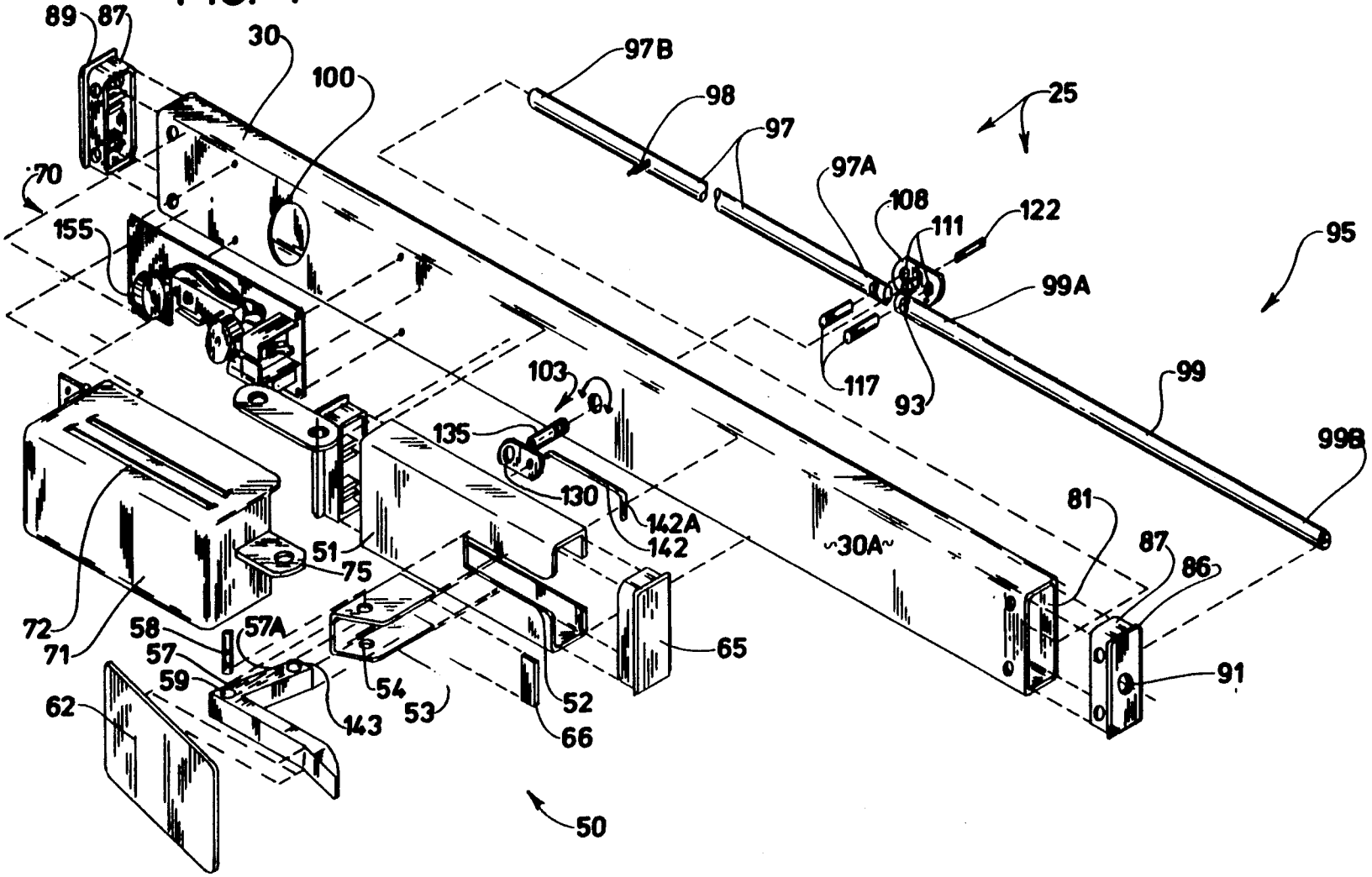
FIG. 4 is an exploded, isometric view thereof.

With additional reference directed now to FIGS. 2–4, the elongated, rigid housing 30 comprises a hollow interior 81 sealed at its opposite ends by rigid end caps 86. End caps 86 preferably comprise a rigid skirt 87 adapted to slip-fit within the interior 81 of housing 30 and a smoothly contoured, plastic face plate 89. Each face plate 89 comprises a central orifice 91 (FIG. 4) adapted to slidably deflect the locking rod into its port. The locking rod is mechanically controlled by handle assembly 50.

As best viewed in FIG. 2–4, handle assembly 50 comprises a rigid, hollow casing 51. Casing 51 is preferably permanently welded to the front 30A of housing 30. Casing 51 securely encloses the working components of the handle assembly 50 to protect them from the elements and from tampering or destruction by vandals. Casing 51 comprises an elongated slot 52 that receives the rotatable paddle arm 57.

The rigid, generally L-shaped paddle arm 57 is pivotally secured within a rigid, generally U-shaped bracket 53. Bracket 53 is slip fitted within casing slot 52 and its terminal end is preferably welded to housing surface 30A. Arm 57 is journaled for rotation therein about a rigid pin 58 which penetrates the bracket mounting orifices 54 and a corresponding orifice 59 defined in bracket 57 (FIG. 4). Interior end 57A of the paddle arm projects into the bracket 53 and casing 51 and is mechanically coupled to the rod assembly 95 described hereinafter.

At its outer end 57C, paddle arm 57 terminates in a rigid, generally planar push plate 62. Plate 62 provides a large exterior surface that can be easily contacted by a user desiring to exit in case of emergency. In the best mode, plate 62 mounts a rigid sign panel 63 that clearly displays appropriate emergency instructions (FIG. 1). Panel 63 can be adhesively attached, or it can be fastened to plate 62 by a plurality of rivets or similar fasteners 64 (FIG. 3).

Once the handle 50 is properly assembled, it is sealed within casing 51 by rigid end caps 65. End caps 65 preferably slip fit into opposite ends of casing 51, so that they may be selectively removed to facilitate maintenance and repair. Rigid stop 66 is then welded to the casing 51 adjacent bracket 53 to limit rotation of paddle arm 57 and to provide additional structural reinforcement.

Handle assembly 50 enables manipulation of the rod assembly broadly designated by the reference numeral 95 to selectively lock and unlock the door. In the best mode, deployment of the handle assembly 50 simultaneously unlocks the door and activates alarm assembly 70 to alert security officers or other building occupants that the emergency door 33 has been opened.

Preferably alarm assembly 70 is protectively sealed within a rigid, box-like shroud 71 positioned generally adjacent handle assembly 50. Shroud 71 comprises a plurality of venting louvers 72 for dissipating heat and sound generated by the alarm assembly 70. Preferably shroud 71 is pivotally coupled at one end to casing 30 by a rotatable hinge 73, which is secured to casing 30 by a plurality of fasteners 74.

At its opposite end, shroud 71 comprises a rigid tab 75. Tab 75 is preferably drilled to register with rigid locking plate 76 associated with casing 30. Insertion of a rigid bar or padlock through tab 75 and locking plate 76 temporarily secures shroud 71 against undesired tampering or damage. As described hereinafter, the alarm system 70, which is activated in response to movement of the locking rod assembly 95.

Figure 5:
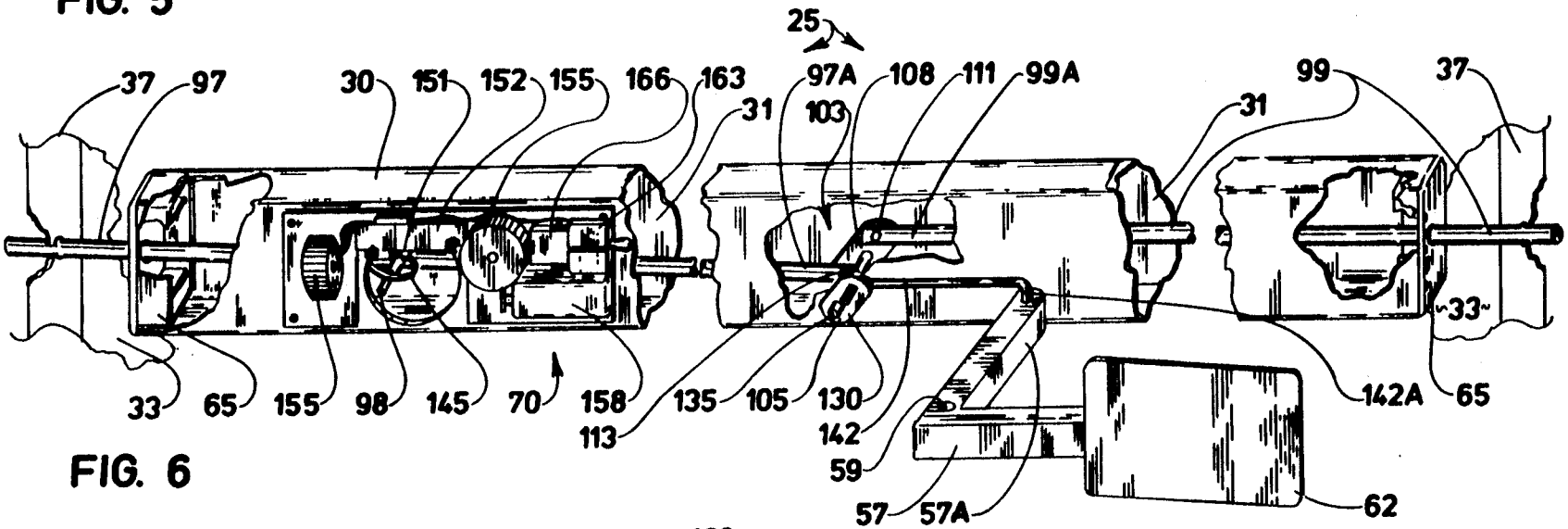
FIG. 5 is a fragmentary perspective view illustrating the rod assembly in its locked position, and in which portions thereof have been omitted or broken away for clarity.

With specific reference to FIG. 4, rod assembly 95 comprises a pair of cooperating, elongated, rigid rods 97, 99. Rods 97, 99 extend longitudinally through housing 30 and project outwardly through orifices 91 into opposing door casings 37 (FIGS. 1, 5). Rods 97, 99 are preferably formed of unitary lengths of cold-rolled or hardened steel at least one-half inch in diameter. A rigid follower 98 projects integrally upwardly from rod portion 97 through a generally circular slot 100 defined through casing 30. When the rods are activated, follower 98 moves within slot 100 and forcibly contacts an alarm switch 145, which in turn activates the alarm assembly 70 as described hereinafter.

Figure 6:
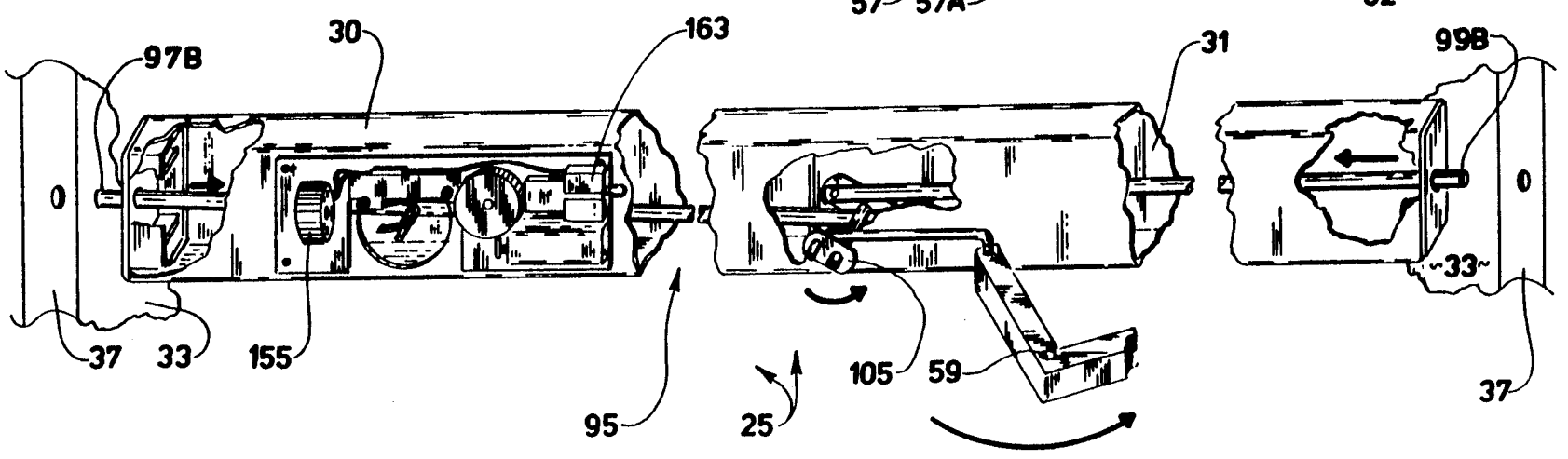
FIG. 6 is a fragmentary perspective view similar to FIG. 5, but illustrating the rod assembly in its unlocked position; and, FIG. 7 is an electrical schematic diagram illustrating the preferred alarm circuit.

As best viewed in FIGS. 4–6, rods 97, 99 are maintained in spaced apart, generally axial relationship by a rigid, rotatable coupler 108. Rods 97, 99 are pivotally coupled at their interior ends 97A, 99A to coupler 108 forming part of the crank assembly broadly designated by the reference numeral 103. Rods 97, 99 are penetrated by rigid pins 117 which register with rod orifices 93 (FIG. 4) are received by and welded within coupler orifices 111. Rods 97, 99 are axially displaced by pins 117 when coupler 108 rotates. Coupler 108 comprises a pair of spaced apart mounting orifices 111 and an integral, generally tubular mounting socket 113. Socket 113 is rotatably mounted upon rigid axle 122 that is welded to the rear wall of housing 30 and projects toward housing front 30A. Coupler 108 rotates about axle 122, alternately extending and retracting rods 97, 99 within housing 30. Orifices 111 are preferably spaced apart equidistant from socket 113, so that rotation of coupler 108 results in simultaneous, equidistant translation of rods 97, 99. Pins 117 cannot escape orifices 93 (i.e. separate from the rods 97 or 99) because there is not enough clearance within housing 30. In other words, the rods and coupler closely abut the interior walls of the housing so they cannot separate from pins 117. For example, coupler 108 closely abuts interior wall 31 (FIG. 5) of housing 30, so pins 117 cannot move axially; rods 97 and 99 closely abut the interior opposite wall 35 (FIG. 2), and cannot move away from pins 117.

Coupler 108 rotates in response to manipulation of a crank 130 associated with handle assembly 50. The rigid, generally planar crank 130 is welded to nipple 135, which threadably mates with socket 113 of the coupler 108. When the handle is activated, it turns crank 130, which in turn urges coupler 108 into rotation about axle 122, so that the rods 97, 99 move.

Crank 130 is mechanically linked to handle assembly 50 by link 142. The elongated, rigid link 142 terminates in an angular end 142A that is slidably received within orifice 143 of paddle arm 57. When the push plate 62 is depressed, paddle arm 57 rotates within bracket 53, forcibly displacing link 142 and rotating crank 105. Crank 105 rotates coupler 108, which retracts rods 97, 99 out of engagement with door facings 37.

In operation, rods 97, 99 are selectively deployed between a locked position shown in FIG. 5 and an unlocked position of FIG. 6. In the locked position of FIG. 5, plate 62 projects outwardly away from housing 30. Paddle arm 57 pulls link 142 and crank 105 toward the paddle arm 57. Nipple 135 drives coupler 108 into a position roughly 45 degrees from the upright. Rods 97, 99 are extended, so that their outer ends 97B, 99B project into opposing door facings 37. The rods thus function similar to deadbolts, penetrating into the casing and securing the door against forcible opening by conventional hand tools such as pry bars. In the locked position, follower 98 is out of contact with the alarm switch 145.

When it is desired to unlock the door for an emergency exit, a user applies pressure against plate 62, causing paddle arm 57 to rotate backward until it contacts stop 66. Arm 57 drives link 142 against crank 105, urging the crank into rotation about shaft 135. Crank 105 rotates coupler 108 to a position roughly negative 45 degrees from the upright. As coupler 108 rotates backward, rods 97, 99 are retracted into casing 30, so that their exterior ends 97B, 99B disengage the door casings 37. Thus, the door can be opened normally.

As the rod assembly 95 retracts, follower 98 slidably engages switch 145 that activates the alarm system. Switch 145 depresses contact 151 that activates alarms 155. In the best mode, alarms 155 comprise dual audio buzzer alarms preferably powered by a conventional nine-volt battery 158.

Preferably a key switch 163 is provided to selectively disarm the alarm circuit. When the key switch 163 is switched to "Off," relay 166 prevents activation of alarms 155. Once the alarm is thus disarmed, it must be reset for subsequent activation. Resetting is achieved by pulling paddle arm 57 forward to the locked position and turning the key switch to "On", so that subsequent deployment of the handle 50 will activate the alarm.

Figure 7:
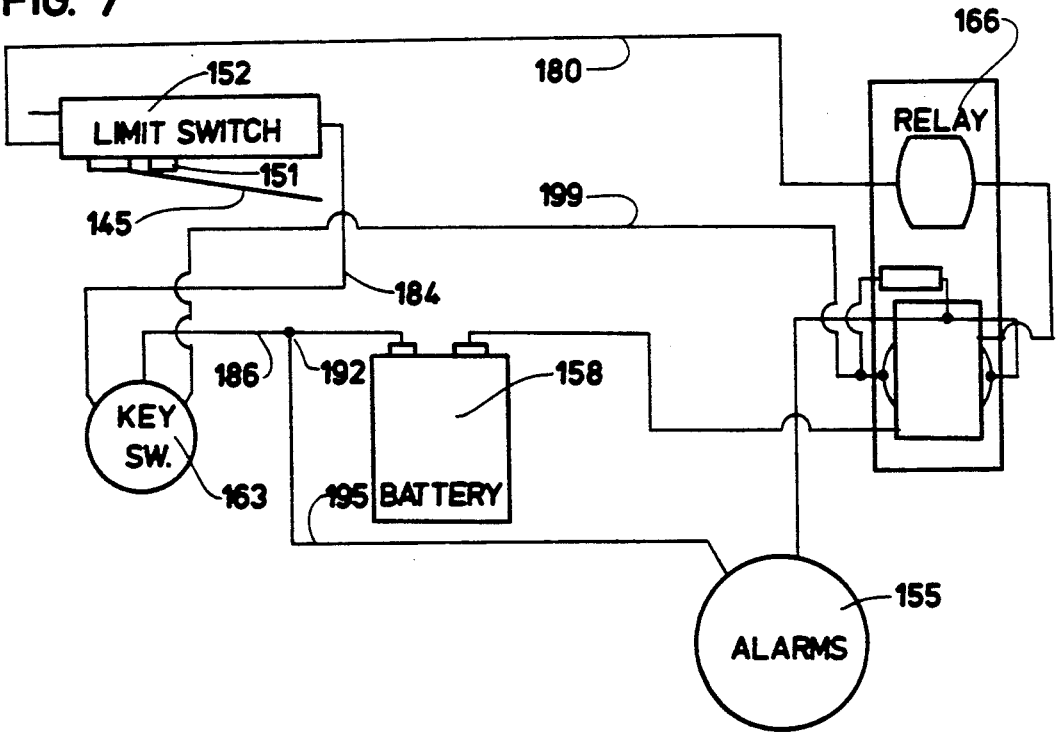

With reference now directed to FIG. 7, contact 151 associated with limit switch 152 is coupled to relay 166 through line 180. Switch 152 is coupled to key switch 163 through line 184 and in turn to battery 158 through line 186. Line 186 terminates in node 192, at which line 195 couples alarms 155 to the key switch. When the key switch is "On," power is supplied through line 195 to the alarms. When the key switch is "Off," power is directed via line 199 through relay 166.

Alternatively, switch 152 may be coupled to an existing A.C. power source adapted to activate a remote alarm (not shown). Thus, unauthorized activation of the exit would transmit a signal to a remote security station.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. An emergency exit alarm lock adapted to be installed upon a door, said lock comprising:

elongated housing means for mounting said lock to said door, said housing means comprising an interior space defined between opposite walls;

rod means slidably confined within said housing means for selectively securing said door against forcible entry, said rod means comprising a first elongated rod adapted to penetrate one door facing and a second rod adapted to penetrate an opposite door facing;

coupler means disposed within said housing means for converting rotary motion into longitudinal motion to simultaneously actuate both of said rods, said coupler means confined within said housing means between said rod means and one of said walls;

rotatable crank means disposed exteriorly of said housing means for activating said coupler means;

handle means for operating said crank means;

link means for interconnecting said handle means with said crank means; and;

alarm means responsive to rod displacement for providing an alert when the door is opened, said rod means comprising an integral follower for contacting and activating said alarm means when said first and second rods are displaced.

2. An emergency exit alarm lock for installation upon doors, said lock comprising:

elongated housing means for mounting said lock to a door, said housing means comprising an interior space defined between opposite walls and a pair of ends terminating adjacent sides of the door;

rod means slidable confined within said housing means for selectively engaging locking orifices defined adjacent the door, said rod means comprising a pair of cooperating rods displaceable between extended and retracted positions;

rotatable coupler means disposed within said housing means for simultaneously activating both of said rods, said coupler means confined within said housing between said rod means and one of said walls;

pin means for fastening said coupler means to said rods;

rotatable crank means disposed exteriorly of said housing means for activating said coupler means;

handle means for operating said lock;

casing means externally mounted upon said housing means for mounting said handle means; and, link means for interconnecting said handle means with said crank means through said casing means.

3. The lock as defined in claim 2 including alarm means responsive to rod displacement for providing an alert when the door is opened.

4. The lock as defined in claim 1 wherein:

said housing means further comprises externally mounted casing means for mounting said handle means;

said coupler means and said crank means are connected by a rigid axle means extending between said coupler means and said crank means through said housing means; and, said handle means comprises a rotatable paddle arm and rigid panel means for displaying written indicia.

5. The lock as defined in claim 4 wherein said alarm means is self powered, self contained and mounted on said housing means, and said alarm means is coupled to a remote alarm system.

6. An emergency exit alarm lock for horizontal installation upon a door, said lock comprising:

elongated housing means for mounting said lock to the surface of said door, said housing means comprising an interior space defined between opposite walls and a pair of ends terminating adjacent sides of the door each of said ends defining a guide orifice;

rod means slidably confined within said housing means and passing through said guide orifices for selectively engaging locking orifices defined adjacent the door, said rod means comprising a pair of cooperating rods displaceable between extended and retracted positions;

coupler means disposed within said housing means for converting rotary motion into longitudinal motion to simultaneously actuate both of said rods, said coupler means confined within said housing between said rod means and one of said walls;

fixed pin means for fastening said coupler means to said rods and for suspending said rod means between said coupler means and said guide orifices with the rod means contacting no other unyielding surfaces;

rotatable crank means disposed exteriorly of said housing means for activating said coupler means;

axle means for axially connecting said crank means with said coupler means through said housing means;

handle mans for operating said crank means and for displaying indicia;

casing means externally fixed on said housing means for mounting said handle means;

link means for interconnecting said handle means with said crank means within said casing means;

follower means disposed on said rod means for slidably activating a switch; and, alarm means connected to said switch for providing an alert when the door is opened.

7. The lock as defined in claim 6 wherein said alarm means is self contained and externally mounted on said housing means.

* * * * *